United States Patent [19]

Fitzgerald-Smith et al.

[11] 4,180,364

[45] Dec. 25, 1979

[54] PONTOON LAUNCHING

[75] Inventors: James P. Fitzgerald-Smith, Ossemsley nr. New Milton; Derek I. Knight, Bournemouth, both of England

[73] Assignee: The Secretary of State for Defence in Her Britannic Majesty's Government of the United Kingdom of Great Britain and Northern Ireland, London, England

[21] Appl. No.: 879,989

[22] Filed: Feb. 22, 1978

[30] Foreign Application Priority Data

Feb. 23, 1977 [GB] United Kingdom ..... 7734/77

[51] Int. Cl.[2] ..... B60P 1/04

[52] U.S. Cl. ..... 414/350; 9/1.1; 280/33.99 T

[58] Field of Search ..... 214/372, 501, 505, 515; 9/1.1, 30; 114/61, 259, 260; 280/33.99 T

[56] References Cited

U.S. PATENT DOCUMENTS

| | | | |
|---|---|---|---|
| 1,416,515 | 5/1922 | Saunders | 280/33.99 T |
| 2,964,764 | 12/1960 | Hickson | 9/30 |
| 3,009,589 | 11/1961 | Martz | 214/505 X |
| 3,812,988 | 5/1974 | Pyle | 214/505 |

FOREIGN PATENT DOCUMENTS

| | | | |
|---|---|---|---|
| 233866 | 4/1960 | Australia | 214/515 |
| 446172 | 11/1912 | France | 9/1.1 |
| 1169779 | 11/1969 | United Kingdom | 9/1.1 |

*Primary Examiner*—Albert J. Makay
*Assistant Examiner*—Terrance L. Siemens
*Attorney, Agent, or Firm*—Pollock, Vande Sande and Priddy

[57] ABSTRACT

This invention provides a convenient and quick method of launching pontoons and further provides a launch vehicle and pontoons for use in said method. The method provides for positioning a tiltable platform, loaded with a stack of nested pontoons, on the bank of a waterway and for tilting the platform and releasing each pontoon separately in a sequence from the uppermost to the lowermost thereby causing the pontoons, in sequence, to slide downwardly of the tilted platform to clear the vehicle and land in the waterway.

12 Claims, 5 Drawing Figures

PONTOON LAUNCHING

This invention relates to pontoon launching.

Pontoon bridges and pontoon rafts are well known in the art and are useful for military and other temporary applications. Hitherto the launching of the pontoons from a bank of a waterway has been a time consuming and inconvenient task.

This invention seeks to provide a convenient and quick way of launching pontoons and provide a launch vehicle and pontoons for this purpose.

Accordingly, one aspect of this invention provides a launch vehicle for nestable slideable pontoons, the vehicle comprising a platform to support two or more pontoons when stacked, by nesting each pontoon within another, in a substantially vertical stack, anchoring means to separately anchor each of the pontoons to the platform, tilting means to tilt the platform and releasing means, co-operable with said anchoring means, to release separately each pontoon in a sequence from the uppermost to lowermost of the pontoons, whereby in use the released pontoons slide downwardly off the tilted platform to clear the vehicle.

Accordingly, another aspect of this invention provides a method of launching pontoons, using a launch vehicle as defined above loaded with a substantially vertical stack of pontoons stacked by nesting each pontoon within another, including the steps of a. positioning the vehicle on the bank of a waterway, b. tilting the platform, c. releasing each pontoon separately and in a sequence from the uppermost pontoon to the lowermost pontoon thereby causing the pontoons, in sequence, to slide downwardly off the tilted platform to clear the vehicle and land in the waterway.

This invention also extends to a pontoon for use with a launch vehicle as defined above said pontoon having an externally substantially flat bottom, inclined sides which are outwardly inclined from said bottom, a substantially planar bow which is outwardly inclined from said bottom, at least 2 skids which extend along the exterior of the bow and bottom, and at least 2 rollers mounted at the upper edge of the bow with their rotational axes substantially perpendicular to the longitudinal axes of the skids such that when a similar pontoon is nested within said pontoon and the two pontoons are tilted by raising the stern of the lower pontoon the upper is caused to slide out of the lower during which sliding the rollers of the lower pontoon make rolling contact with the skids of the upper pontoon.

Preferably the bow is inclined at 30° to the bottom.

Preferably the sides, bow and bottom are made of aluminium.

Advantageously the pontoons are provided with self draining means for the automatic draining of water from the interior of the pontoon.

The platform of the launch vehicle may be provided with rollers mounted on outwardly extending arms, said rollers, in use, making rolling contact with the lowermost pontoon when it slides downwardly to clear the vehicle.

The anchoring means may comprise a releasable latch for each pontoon and a support member to which the latches may be attached. The releasing means may be a cable for each of the latches and preferably there is provided an interlock device for preventing the latches being released out of sequence. The interlock device may comprise two or more operating levers for operating a corresponding two or more latches of the anchoring means and a slideably mounted plate having cut-out portions forming a gate for each of the operating levers such that the levers may only be operated in a predetermined sequence and only one lever may be operated at a time.

The releasable latch may comprise a mounting member; a bifurcated member pivotally mounted on said mounting member; an arm, pivotally mounted on said mounting member, having biasing means for urging the arm into a first position; one end of the arm adapted to hold, when the arm is in said first position, the bifurcated member in an operative position such that a pontoon may be held in an anchored state, the other end of the arm adapted to receive said cable such that tensioning the cable causes the arm to pivot to a second position in which the bifurcated member is released from its operative position. The biasing means may comprise a spring loaded cam follower mounted upon the arm and a co-operating cam surface upon the mounting member.

The invention will now be described, by way of example only, with reference to the accompanying drawings, of which:

Figure 1:
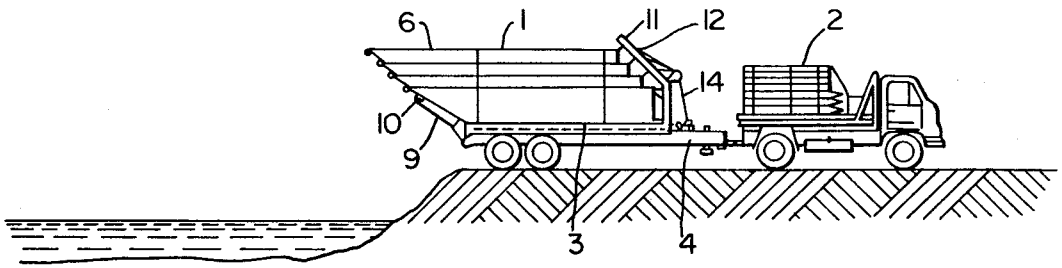
FIG. 1 shows a side elevation of a launch vehicle, loaded with a stack of pontoons, and a towing lorry.
Figure 2:
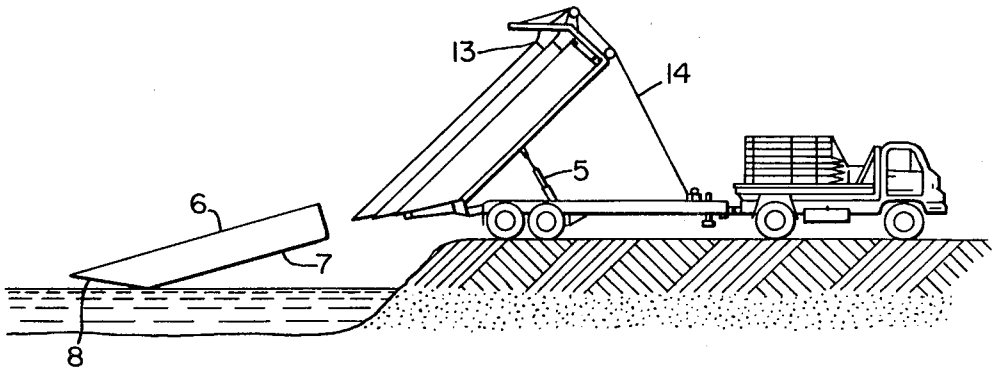
FIG. 2 shows a side elevation of the launch vehicle, of FIG. 1 with its platform tilted to launch a pontoon.

Referring firstly to FIGS. 1 and 2, the launch vehicle is in the form of a trailer 1 towed by a lorry 2. Trailer 1 has a tiltable platform 3 mounted on a wheeled chassis 4, the tilting means comprising a hydraulic jack 5. The trailer is shown with a full load of four nestable slideable pontoons 6.

The pontoons 6 must be slideable one within the other. The pontoons have externally substantially flat bottoms 7 and broad planer bows 8, seen more clearly in FIG. 3. They are arranged on the platform 3 such that their bows 8 are in echelon and directed to the rear of the platform where arms 9 bearing guide rollers 10 project outwardly of the platform 3. At the opposite (front) end of the platform 3 the anchoring means is situated. This comprises a support member 11 supporting a number of releaseable latches 12 as illustrated in FIG. 4. The latches each comprise a mounting member 41 which is secured to the support member 11, and bears a pivoted bifurcated member 42 by which a pontoon 6 is secured, through a tie bar 13, to the platform. The pontoon is secured in an anchored state by having the tie bar 13 located in the aperture defined by the bifurcated member 42, when in the position (hereinafter referred to as its operative position) shown, and the mounting member 41. In FIG. 4 the bifurcated member 42 is shown cross-hatched to distinguish from the mounting member 41. The member 42 is held in its operative position by means of an arm 43 which is also pivoted to the mounting member 41 at 44. The arm 43 bears an end roller 45 which in the position shown engages the bifurcated member 42 to prevent rotation thereof. A cable 14, not shown in FIG. 4, is attached to the free end 46 of the arm 43, and when this cable is tensioned it pivots the arm against the action of a spring biased cam follower 47 to disengage roller 45 from the bifurcated member 42 and so release the latter. The cable 14 for each bifurcated member 42 is manually tensionable from a nontilting position on the chasais 4. Preferably an interlock device is provided to prevent release of the bifurcated members 42 in other than the correct sequence.

Figure 5:
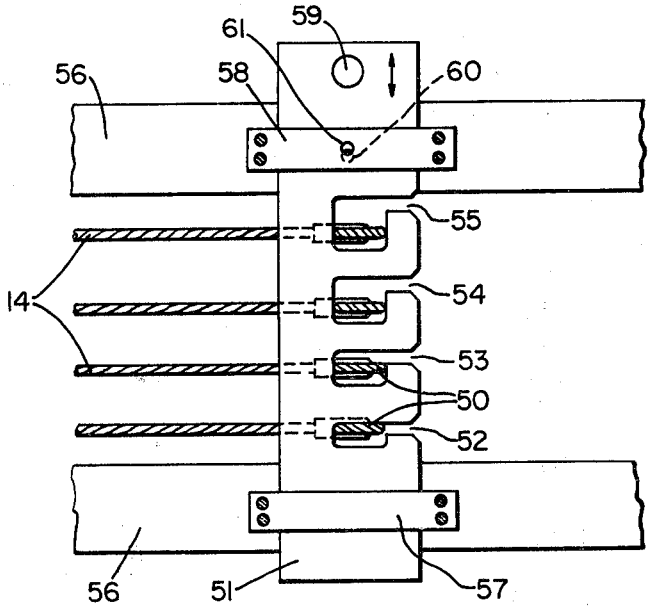
FIG. 5 shows an interlock device.

FIG. 5 is a plan view of an interlock device. A cable 14 (FIGS. 1 and 2) is attached to each arm 43 (FIG. 4) of the latches and to a corresponding operating lever 50 of the interlock device. The levers 50 are pivotally mounted at their lower ends (not shown), consequently pulling the levers to the right causes them to tension their respective cables 14 which in turn causes the arm 43 to pivot and release the bifurcated member 42.

In FIG. 5 the cable 14 from the bottom lever 50 is attached to the arm of the latch co-operable with the uppermost pontoon and the cables of the succeeding upwardly adjacent levers 50 are attached to the latches co-operable with the succeeding respective downwardly adjacent pontoons. The interlock device also includes a slideably mounted plate 51 which is provided with cut-out portions 52 through to 55 forming gates for the levers 50. The plate 51 is slideably mounted on a frame 56 by bridge members 57 and 58 which constrain the plate to sliding motion in the direction shown by the arrows. A handle 59 is mounted normally upon the plate 51. The plate is also provided with a hole 60 for co-operation with a similar hole 61 in the bridge member 58. The plate may be locked in position by aligning the holes 60 and 61 and inserting a pin (not shown) into said holes. When locked in such a position the gates 52 to 55 co-operate with the levers 50 to prevent their operation and consequently release of the pontoons. In use, to release the pontoons in sequence, the plate 51 is released from its locked position and slideably urged by means of the handle 59 in a downward direction (in the figure) until the upper edge of gate 52 abuts the bottom lever 50. Said lever may be pulled to the right out of the gate to, as aforesaid, release the uppermost pontoon. The plate 51 may then again be urged in a downward direction until the upper edge of gate 53 abuts the next, upwardly adjacent, lever 50. That lever my then be pulled to the right out of the gate to release the next, downwardly adjacent, pontoon. Release of the remaining 2 pontoons is achieved in a similar manner. It will be seen from the figure that the gates are dimensioned at their leftward ends so that only one of the unoperated levers is operable at any time. Moreover, the dimensions of successive gates are scaled so that operation of the levers can only occur in a predetermined sequence ie in the example shown, commencing with the bottom lever, continuing with the upwardly adjacent levers and ending with the uppermost lever.

Figure 3:
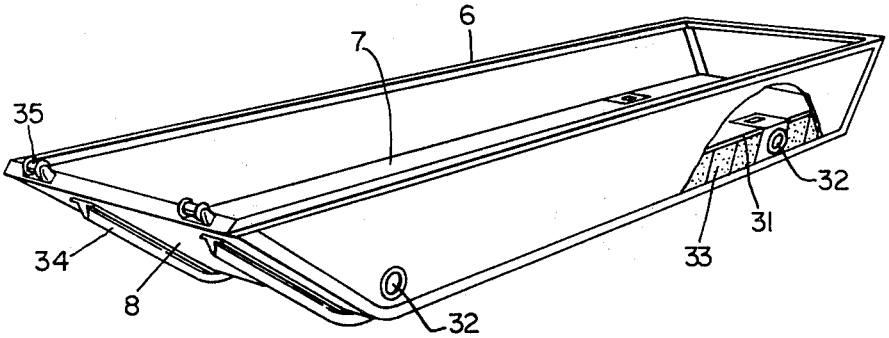
FIG. 3 shows an isometric projection, partly sectioned, of a pontoon.
Figure 4:
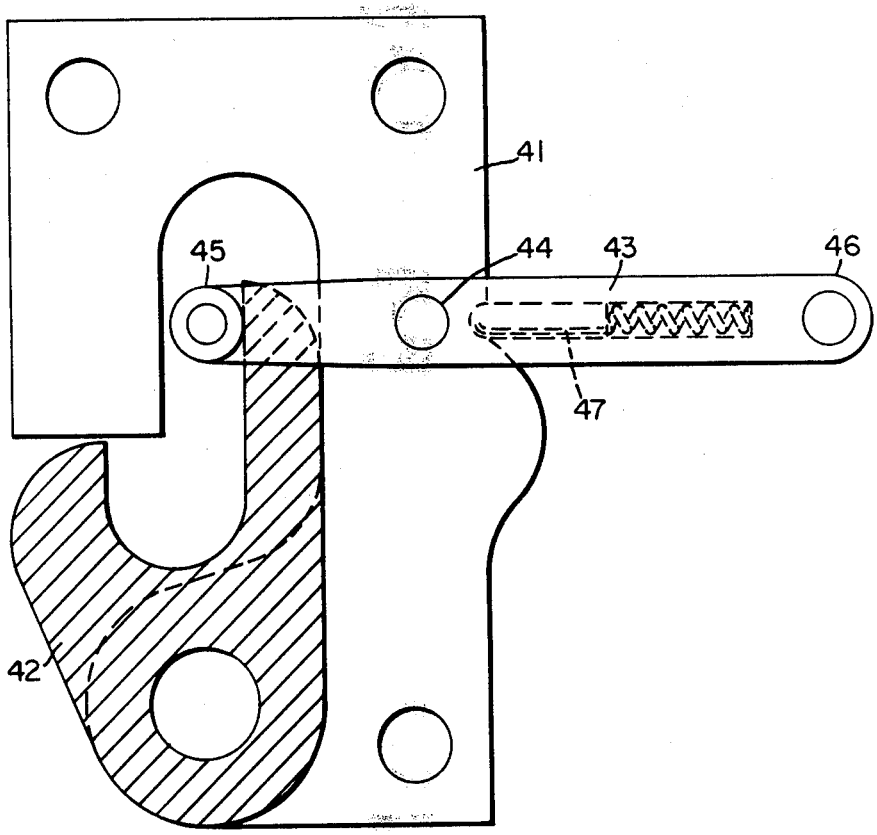
FIG. 4 shows a side elevation of a releasable latch.

Referring now to FIG. 3, one of the pontoons 6 can be seen in more detail. The bow 8, sides 31 and bottom 7 are made of aluminium for lightness. The sides 31 and bow 8 are inclined outwardly from the bottom 7. As the pontoons are of open construction to permit nesting they are liable to collect rain water inside them. To prevent any accumulation of water in the pontoons they are fitted with self draining means comprising self draining valves 32 and buoyancy compartment 33. The latter provides a positive head to the valves 32. Along the underside of the bottom 7 and up the bow 8 of the pontoon extend skids 34, and rollers 35 are provided at the upper edge of the bow 8. The rotational axes of the rollers are substantially perpendicular to the longitudinal axes of the skids.

The use and operation of the launch vehicle described above will now be discussed with reference to FIGS. 1 and 2. The trailer 1, loaded with a stack of pontoons 6 is used to transport these to the bridge site. The trailer 1 can carry a full load of four pontoons. At the bridge site the trailer is positioned close to the waterway as shown in FIG. 1. Then the platform 3 is tilted towards the waterway by means of the hydraulic jack 5 and the uppermost pontoon 6 is released from its releasable latch by tensioning the respective cable 14. The bifurcated member 42 is thus released and the uppermost pontoon 6 begins to slide downwards of the platform 3 on its skids 34 and over the downwardly adjacent pontoon. During its motion up and over the bow of the downwardly adjacent pontoon the uppermost pontoon has its skids 34 supported upon and making rolling contact with the rollers 35 of the downwardly adjacent pontoon. The rollers 35 minimise the friction experienced by the sliding pontoon. By minimising this friction the pontoons can be launched with the minimum tilt of the platform. After releasing the uppermost pontoon and launching it in the manner described the remaining pontoons are launched separately in a similar manner in a sequence from the uppermost to the lowermost. The lowermost pontoon is supported directly upon the platform 3 and the arms 9 and their rollers 10 function to reduce the friction during sliding in the same way as the bow rollers 35 act for the other pontoons and function to convert the downward movement of the pontoon into a more horizontal motion to prevent it diving under the water. The launch vehicle is fitted with a winch (not shown) to enable recovery of the pontoons after use.

What I claim is:

1. A launch vehicle for nestable slideable pontoons, the vehicle comprising:

(a) a platform to support two or more pontoons when stacked, by nesting each pontoon within another, in a substantially vertical stack, (b) anchoring means to separately anchor each of the pontoons to the platform, (c) tilting means to tilt the platform, and (d) releasing means, co-operable with said anchoring means, to release separately each pontoon in a sequence from the uppermost to the lowermost of the pontoons, whereby, in use, the released pontoons slide downwardly of the tilted platform to clear the vehicle.

2. A launch vehicle according to claim 1 in which the platform is provided with outwardly extending arms and a roller mounted on each arm such that, in use, said rollers make rolling contact with the lowermost pontoon when it slides downwardly to clear the vehicle.

3. A launch vehicle according to claim 1 in which the anchoring means includes a releasable latch for each pontoon and a support member to which the latches may be attached.

4. A launch vehicle according to claim 3 in which the releasing means is a cable.

5. A launch vehicle according to claim 4 in which the releasable latch comprises:

(a) a mounting member, (b) a bifurcated member pivotally mounted on said mounting member, (c) an arm, pivotally mounted on said mounting member, having biassing means for urging the arm into a first position, wherein one end of the arm is adapted to hold, when the arm is in said first position, the bifurcated member in an operative position such that a pontoon may be held in an anchored state, and wherein the other end of the arm is adapted to receive said cable such that tensioning the cable causes the arm to pivot to a second position in which the bifurcated member is released from its operative position.

6. A launch vehicle according to claim 5 in which the biassing means comprises a spring loaded cam follower mounted upon the arm and a co-operating cam surface upon the mounting member.

7. A launch vehicle according to claim 3 in which there is provided an interlock device for preventing the latches being released out of sequence.

8. A launch vehicle according to claim 7 in which the interlock device comprises two or more operating levers for operating a corresponding two or more latches and a slideably mounted plate having cut-out portions forming a gate for each of the operating levers such that the levers may only be operated in a pre-determined sequence and only one lever may be operated at a time.

9. A launch vehicle according to claim 1 wherein at least one of said pontoons has an externally substantially flat bottom, inclined sides which are outwardly inclined from said bottom, a substantially planar bow which is outwardly inclined from said bottom, at least two skids which extend along the exterior of the bow and bottom, and at least two rollers mounted at the upper edge of the bow with their rotational axes substantially perpendicular to the longitudinal axes of the skids such that when a similar pontoon is nested within said pontoon and the two pontoons are tilted by raising the stern of the lower pontoon the upper is caused to slide out of the lower during which sliding the rollers of the lower pontoon make rolling contact with the skids of the upper pontoon.

10. A launch vehicle according to claim 9 in which the pontoon bow is inclined at 30 degrees to the bottom.

11. A launch vehicle according to claim 9 in which the pontoon side, bow and bottom are made of aluminium.

12. A launch vehicle according to claim 9 in which there is provided self-draining means for the automatic draining of water from the interior of the pontoon.

* * * * *